US011008830B2

(12) United States Patent
Hu et al.

(10) Patent No.: US 11,008,830 B2
(45) Date of Patent: May 18, 2021

(54) STRATIFIED WATERFLOODING APPARATUS

(71) Applicant: PetroChina Company Limited, Beijing (CN)

(72) Inventors: Gaixing Hu, Beijing (CN); Hongjun Lu, Beijing (CN); Bin Yao, Beijing (CN); Yafeng Ju, Beijing (CN); Jiuzheng Yu, Beijing (CN); Lingzhi Yang, Beijing (CN); Fuwei Bi, Beijing (CN); Zijian Wang, Beijing (CN); Loulou Li, Beijing (CN)

(73) Assignee: PETROCHINA COMPANY LIMITED, Beijing (CN)

( * ) Notice: Subject to any disclaimer, the term of this patent is extended or adjusted under 35 U.S.C. 154(b) by 77 days.

(21) Appl. No.: 16/529,694

(22) Filed: Aug. 1, 2019

(65) Prior Publication Data

US 2020/0115991 A1 Apr. 16, 2020

(30) Foreign Application Priority Data

Oct. 15, 2018 (CN) ..... 201811195527.9

(51) Int. Cl.
*E21B 43/20* (2006.01)
*E21B 34/06* (2006.01)
(Continued)

(52) U.S. Cl.
CPC ..... *E21B 34/066* (2013.01); *E21B 43/20* (2013.01); *E21B 47/10* (2013.01); *E21B 33/12* (2013.01); *E21B 43/14* (2013.01)

(58) Field of Classification Search
CPC ..... E21B 34/066; E21B 47/10; E21B 43/20; E21B 43/14; E21B 33/12
See application file for complete search history.

(56) References Cited

U.S. PATENT DOCUMENTS 3,665,955 A * 5/1972 Conner, Sr. ..... E21B 34/16 137/495
5,732,776 A * 3/1998 Tubel ..... E21B 47/12 166/250.15

(Continued)

FOREIGN PATENT DOCUMENTS

CN 101775976 A 7/2010
CN 201810292 U 4/2011

(Continued)

OTHER PUBLICATIONS

First Office Action dated Sep. 2, 2020 for counterpart Chinese patent application No. 201811195527.9, 15 pages.

(Continued)

*Primary Examiner* — Brad Harcourt
(74) *Attorney, Agent, or Firm* — Loza & Loza, LLP; Michael F. Fedrick

(57) ABSTRACT

The present invention provides a stratified waterflooding apparatus, which comprises: a water distribution unit, which comprises two water distributors, the water distributor having an inner side wall and an outer side wall, the inner and outer side walls forming a first annular cavity therebetween and being respectively provided with a water inlet and a water outlet which are communicated with the first annular cavity, the first annular cavity accommodates a driving mechanism and an adjustable blocking member, the adjustable blocking member having a first operating position in which it blocks the water inlet or the water outlet and a second operating position in which it releases the blocking of the water inlet and the water outlet; and a controller in communication connection with the driving mechanism. The stratified waterflooding apparatus can realize intelligent and automatic regulation of an aperture of the water distributors in the stratified waterflooding process.

7 Claims, 3 Drawing Sheets

(51) Int. Cl.

| | |
|---|---|
| ***E21B 47/10*** | (2012.01) |
| *E21B 43/14* | (2006.01) |
| *E21B 33/12* | (2006.01) |

(56) References Cited

U.S. PATENT DOCUMENTS

| | | | | |
|---|---|---|---|---|
| 5,896,924 | A * | 4/1999 | Carmody | E21B 34/066 166/53 |
| 8,240,369 | B1 | 8/2012 | Nikouline et al. | |
| 2014/0338922 | A1* | 11/2014 | Lopez | E21B 34/066 166/373 |
| 2018/0298725 | A1* | 10/2018 | Minassa | E21B 34/10 |

FOREIGN PATENT DOCUMENTS

| | | | |
|---|---|---|---|
| CN | 202250004 | U | 5/2012 |
| CN | 102900409 | A | 1/2013 |
| CN | 103061726 | A | 4/2013 |
| CN | 103362486 | A | 10/2013 |
| CN | 103590796 | A | 2/2014 |
| CN | 103615223 | A | 3/2014 |
| CN | 104500009 | A | 4/2015 |
| CN | 204679780 | U | 9/2015 |
| CN | 105298456 | A | 2/2016 |
| CN | 106703767 | A | 5/2017 |
| CN | 206158705 | U | 5/2017 |
| CN | 206174939 | U | 5/2017 |
| CN | 105464636 | B | 6/2018 |
| RU | 2541982 | C1 | 2/2015 |

OTHER PUBLICATIONS

Search Report dated Oct. 15, 2018 for counterpart Chinese patent application No. 201811195527.9, 5 pages.

Prior art search report prepared by the China Patent Information Center, dated Jul. 16, 2018.

Shi Liangliang, et al., Research and application of layered intelligent waterflooding string in horizontal wells, Scientific Management, vol. 1, pp. 200-201 (2017).

Chen Penggang, et al., The Research and Application of Bridge-Concentric Stratified Injection Measurement and Adjustment Technology, Unconventional Oil & Gas, vol. 4, No. 3, pp. 99-109, Jun. 2017.

* cited by examiner

STRATIFIED WATERFLOODING APPARATUS

CROSS-REFERENCE TO RELATED APPLICATIONS

This application claims priority to Chinese Patent Application No. 201811195527.9, filed on Oct. 15, 2018, which is hereby incorporated by reference in its entirety.

TECHNICAL FIELD

The present application relates to the technical field of stratified waterflooding, in particular to a stratified waterflooding apparatus.

BACKGROUND

The description in this part only provides background information related to the disclosure of the present invention, and does not constitute the prior art.

During stratified waterflooding of an oil field, the injection allocation amount can be realized by adjusting an aperture of a water distributor. It is a technical problem to be solved urgently as to how to realize intelligent and automatic regulation of the aperture of a downhole water distributor.

It should be noted that the above introduction to the technical background is set forth only for facilitating a clear and complete description of the technical solutions of the present invention and for ease of understanding by those skilled in the art. The above technical solutions should not be regarded as commonly known by those skilled in the art merely because the solutions are depicted in the background part of the present invention.

SUMMARY

On the basis of the aforementioned deficiency of the prior art, the embodiments of the present invention provide a stratified waterflooding apparatus that can realize the intelligent and automatic regulation of the aperture of a water distributor in stratified waterflooding.

In order to achieve the above purpose, the present invention provides the following technical solutions.

The present invention provides a stratified waterflooding apparatus, comprising:

an oil pipe;

a water distribution unit connected to the oil pipe and lowered into a casing pipe, the water distribution unit comprising: two water distributors and a packer connected between the two water distributors, the packer being settable on the casing pipe, and the water distributor having an inner side wall and an outer side wall, the inner and outer side walls forming a first annular cavity therebetween and being respectively provided with a water inlet and a water outlet which are communicated with the first annular cavity, the first annular cavity accommodates a driving mechanism and an adjustable blocking member driven by the driving mechanism, the adjustable blocking member having a first operating position in which it blocks the water inlet or the water outlet such that the water inlet and the water outlet cannot communicate with each other via the first annular cavity and a second operating position in which it releases the blocking of the water inlet and the water outlet so that the water inlet and the water outlet can communicate with each other via the first annular cavity; and a controller in communication connection with the driving mechanism.

Preferably, the packer and the two water distributors form a channel which is used for passage of a liquid therethrough and is communicated with the oil pipe, a downhole data communication device having a first communication module is provided within the channel, the downhole data communication device is in communication connection with the controller, and the first communication module is in communication connection with the driving mechanism.

Preferably, the downhole data communication device is connected with the controller via a cable, which is provided to pass through the oil pipe and the channel.

Preferably, the driving mechanism includes a control circuit in communication connection with the first communication module and a motor connected with the control circuit.

Preferably, the adjustable blocking member is provided with a screw hole on an upper end thereof, an output shaft of the motor is connected with a screw rod, and the screw rod is screwed into the screw hole.

Preferably, the water distributor includes:

an upper joint, a side wall of which forms the outer side wall;

an inner tube connected with the upper joint, a side wall of which inner tube forms the inner side wall.

Preferably, a lower end of the upper joint is connected with a lower joint, a sealed second annular cavity is formed between the lower joint and the upper joint, the second annular cavity accommodates a flow rate detection module and a second communication module in communication connection with the first communication module, an upper end of the flow rate detection module stretches out from the second annular cavity and into the first annular cavity, and the second communication module is in communication connection with the control circuit and the flow rate detection module.

Preferably, the side wall of the upper joint is bent radially inward under the inner tube to form a first sealed section, which is then bent downward to form a second sealed section, and the lower joint and the first and second sealed sections jointly define the sealed second annular cavity.

Preferably, a lower end of the inner tube is spaced apart from the first sealed section to form the water inlet, and an upper end of the flow rate detection module passes through the first sealed section, such that the upper end of the flow rate detection module faces the water inlet.

Preferably, the water outlet is located above the water inlet, the adjustable blocking member blocks the water outlet when it is in the first operating position, and the adjustable blocking member at least partially opens the water outlet when it is in the second operating position.

In the stratified waterflooding apparatus of the embodiments of the present invention, the water inlet and the water outlet which are communicated with the first annular cavity are respectively provided on the inner side wall and the outer side wall of the water distributor, and the adjustable blocking member for blocking or opening the water inlet and the water outlet is provided in the first annular cavity, thus the driving mechanism which is in communication connection with the controller can drive the adjustable blocking member to move in the annular cavity so as to switch between the first operating position and the second operating position, and in this way, the intelligent and automatic regulation of the aperture of a water distributor and the control of opening and closing of a water distributor can be realized.

Referring to the following explanations and accompanying drawings, the specific embodiments of the present invention are disclosed in detail, and the modes in which the principle of the present invention can be used are clearly pointed out. It should be understood that the embodiments of the present invention shall not be limited thereby in scope. The embodiments of the present invention include a lot of alternations, modifications and equivalents within the scope of spirit and clauses of the appended claims.

Features described and/or illustrated with respect to one embodiment may be used in the same way or in a similar way in one or more other embodiments, in combination with or instead of features of the other embodiments.

It should be emphasized that the term "comprise/comprising", when used in this text, is taken to specify the presence of a feature, an integer, a step or a component, but does not preclude the presence or addition of one or more other features, integers, steps or components.

BRIEF DESCRIPTION OF THE DRAWINGS

The figures described here are for explanation purposes only, and are not intended to limit in any way the scope of disclosure of the present invention. Besides, the shapes and scales of the parts in the figures are only schematic to help understanding the present invention, and are not provided to specifically define the shapes and scales of the parts in the present invention. The persons skilled in the art, as taught by the present invention, can select various possible shapes and scales according to specific situations to implement the present invention. In the figures.

DESCRIPTION OF EMBODIMENTS

In order to enable the persons in this technical field to better understand the technical solutions of the present invention, a clear and comprehensive description to the technical solutions in the embodiments of the present invention is given below with reference to the figures in the embodiments of the present invention. Obviously, the embodiments described here are only a part of, rather than all of, the embodiments of the present invention. Based on the embodiments in the present invention, all other embodiments obtained by ordinary skilled persons in this field without paying any creative effort should fall within the scope of protection of the present invention.

It should be clearly stated that when an element is referred to as being "provided on" another element, it can be directly on the other element, or an intervening element may also exist. When an element is referred to as being "connected to" another element, it can be directly connected to the other element, or an intervening element may also exist at the same time. The terms "vertical", "horizontal", "left" and "right" as well as other similar expressions used in this text are for the purpose of explanation only and do not represent the unique embodiment.

Unless otherwise defined, all technical and scientific terms used in this text have the same meaning as commonly understood by the skilled persons of the technical field of the present invention. The terms used in the Description of the present invention are for the purpose of describing the specific embodiments only, and are not intended for limiting the present invention. The term "and/or" used in this text includes any and all combinations of one or more of the associated listed items.

Figure 1:
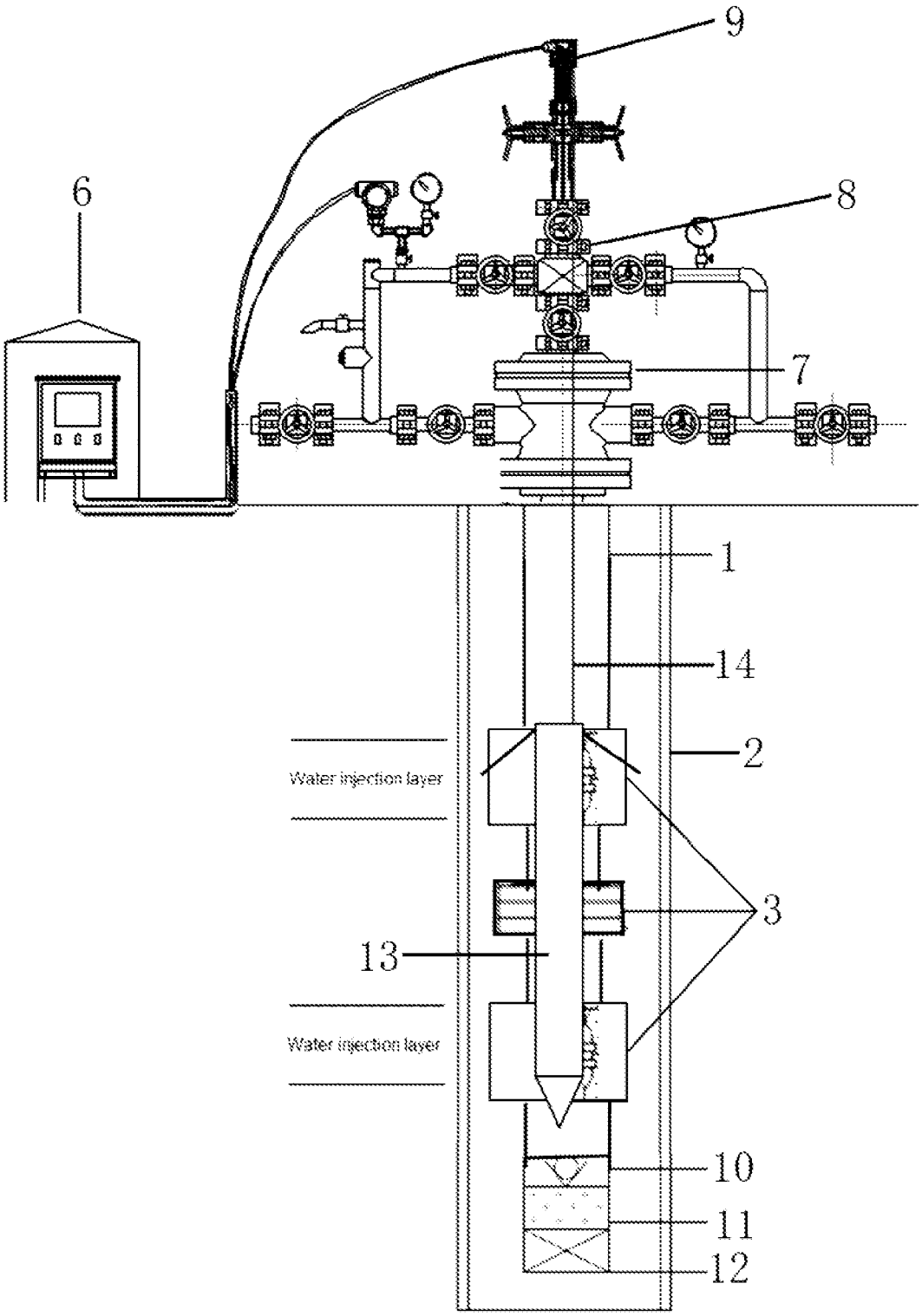
FIG. 1 is a schematic diagram showing the structure of a stratified waterflooding apparatus of an embodiment of the present invention.
Figure 2:
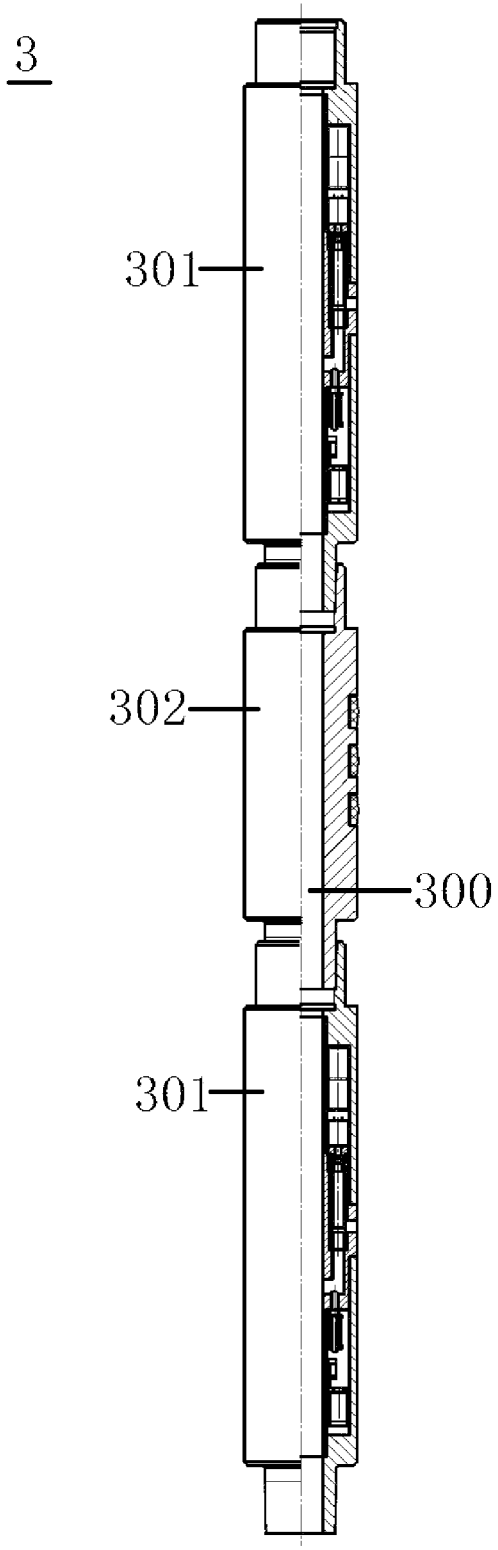
FIG. 2 is a schematic diagram of the structure of the water distribution unit in FIG. 1.

As shown in FIGS. 1 and 2, the embodiments of the present invention provide a stratified waterflooding apparatus, which may comprise: a water distribution unit 3 connected to an oil pipe 1 and lowered into a casing pipe 2, the water distribution unit 3 comprising: two water distributors 301 and a packer 302 connected between the two water distributors 301, the packer 302 being settable on the casing pipe 2 and the water distributors 301 having an inner side wall 303 and an outer side wall 304, the inner side wall 303 and the outer side wall 304 forming a first annular cavity 305 therebetween and being respectively provided with a water inlet 303*a* and a water outlet 304*a* which are communicated with the first annular cavity 305, the first annular cavity 305 accommodates a driving mechanism 4 and an adjustable blocking member 5 driven by the driving mechanism 4, the adjustable blocking member 5 having a first operating position in which it blocks the water inlet 303*a* or the water outlet 304*a* such that the water inlet 303*a* and the water outlet 304*a* cannot communicate with each other via the first annular cavity 305 and a second operating position in which it releases the blocking of the water inlet 303*a* and the water outlet 304*a* so that the water inlet 303*a* and the water outlet 304*a* can communicate with each other via the first annular cavity 305; and a controller 6 in communication connection with the driving mechanism 4.

In the stratified waterflooding apparatus of the embodiments of the present invention, the water inlet 303*a* and the water outlet 304*a* which are communicated with the first annular cavity 305 are respectively provided on the inner side wall 303 and the outer side wall 304 of the water distributors 301, and the adjustable blocking member 5 for blocking or opening the water inlet 303*a* and the water outlet 304*a* is provided in the first annular cavity 305, thus the driving mechanism 4 which is in communication connection with the controller 6 can drive the adjustable blocking member 5 to move in the annular cavity so as to switch between the first operating position and the second operating position, and in this way, intelligent and automatic regulation of an aperture of the water distributors 301 and control of opening and closing of the water distributors 301 can be realized.

In this embodiment, the oil pipe 1, an well head ram blowout preventer 7, a cable ram 8 and a well head cable sealing device 9 are sequentially connected above the water distribution unit 3, and a check valve 10, a sieve tube 11 and a pipe plug 12 are sequentially connected under the water distribution unit 3, wherein the well head ram blowout preventer 7, the cable ram 8, the well head cable sealing device 9, the check valve 10, the sieve tube 11 and the pipe plug 12 may assume any suitable existing constructions, and the present invention does not make limitations to this.

The controller 6 is provided in the form of a control cabinet on the ground or in a central control room, and may be configured with a display for displaying downhole flow rate data and pressure data in real time. Besides, the controller 6 may also be connected with a terminal device such as a mobile phone or a computer via the Internet, in order to facilitate remote operations of the working staff.

The oil pipe 1 is suspended and fixed in the casing pipe 2, an annulus is formed between the oil pipe 1 and the casing pipe 2, and the packer 302 is settled on an inner wall of the casing pipe 2 thereby dividing the annulus into two sub-annulus corresponding to an upper oil layer and a lower oil layer, such that the two water distributors 301 are facilitated to inject water into an upper water injection layer and a lower water injection layer through the two sub-annulus.

A packer of model Y341-114-55-120/25 or other models can be adopted as the spacer 302, which is integrated together with the upper and lower water distributors 301. The pressure for setting the packer 302 is small as it can be set under a pressure of 10 Mpa. Meanwhile, the length of the packer 32 is 0.9 m, which is small too. The packer 32 has functions of sealing, de-sealing and inverse well flushing.

Besides, the packer 302 and the two water distributors 301 form a channel 300 which is used for passage of a liquid therethrough and is communicated with the oil pipe 1, a downhole data communication device 13 having a first communication module is provided in the channel 300 in a way of not blocking flowing of the liquid, the downhole data communication device 13 is in communication connection with the controller 6, and the first communication module is in communication connection with the driving mechanism 4. To be specific, the downhole data communication device 13 is connected with the controller 6 via a cable 14, which is provided to pass through the oil pipe 1 and the channel 300, so as to avoid the problem of complex construction and low operation efficiency caused by bundling the cable 14 outside the oil pipe 1.

Figure 3:
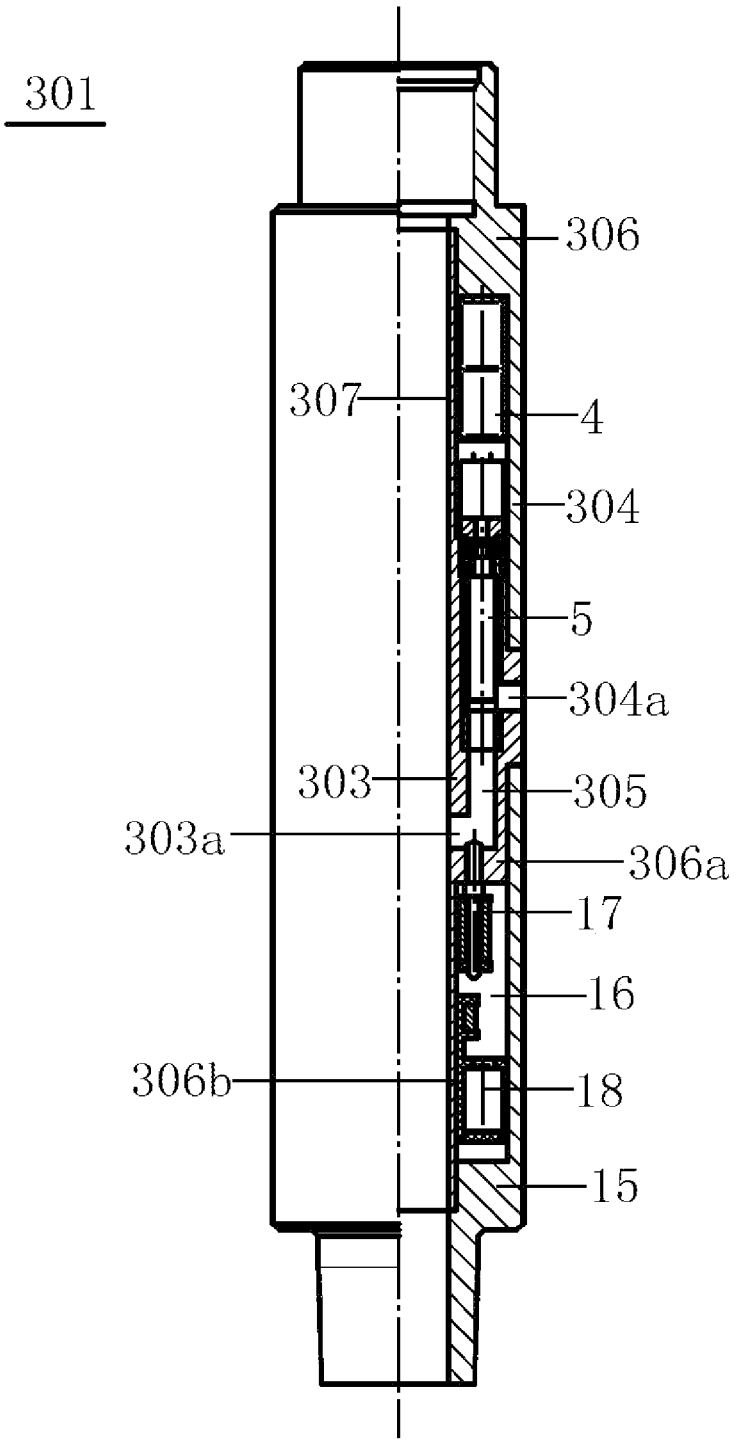
FIG. 3 is a schematic diagram of the structure of the water distributor in FIG. 2.

As shown in FIG. 3, the water distributor 301 may include: an upper joint 306, a side wall of which forms the outer side wall 304; an inner tube 307 connected to the upper joint 306, a side wall of which inner tube forms the inner side wall 303. The specific connecting manner is that the inner tube 307 is connected to an inner wall of the upper joint 306 which is close to the lower end thereof.

The water inlet 303*a* and the water outlet 304*a* which are respectively provided on the inner side wall 303 and the outer side wall 304 are staggered from each other, to be specific, the water outlet 304*a* is located above the water inlet 303*a*. In this way, when the adjustable blocking member 5 is in the first operating position, it blocks the water outlet 304*a* such that the water inlet 303*a* is not communicated with the water outlet 304*a*; and when the adjustable blocking member 5 is in the second operating position, it at least partially opens the water outlet 304*a*, and at this point the water inlet 303*a* is communicated with the water outlet 304*a*, and thereby water injection is realized.

Additionally, the controller 6 controls the size of the area blocked of shielded by the adjustable blocking member 5 as driven by the driving mechanism 4, and thereby realizes the regulation of the aperture of the water distributors 301.

The adjustable blocking member 5 may be formed like an arc-shaped tile, but is preferably in a tubular shape that matches with the inner tube 307, and is sleeved over the inner tube 307. The way in which the driving mechanism 4 drives the adjustable blocking member 5 to move in the first annular cavity 305 is that: the driving mechanism 4 includes a control circuit in communication connection with the first communication module and a motor connected with the control circuit, a screw rod is connected on an output shaft of the motor, the adjustable blocking member 5 is provided with a screw hole on an upper end thereof, and the screw rod is screwed into the screw hole.

The control circuit is connected to the controller 6 via the first communication module. It can receive a control instruction transmitted by the controller 6 via the first communication module so as to control positive and negative rotations and the number of rotations of the motor, thereby controlling the variation of the length in which the screw rod is screwed in the screw hole, and controlling the moving direction and moved distance of the adjustable blocking member 5 in the first annular cavity 305, and thereby realizes control of opening and closing of the water distributors 301 and adjustment of the aperture thereof.

In addition, in order to facilitate the working staff to get to know the water distribution flow rate immediately, the water distributor 301 is equipped with a structure for detecting the water distribution flow rate. To be specific, a lower end of the upper joint 306 is connected with a lower joint 15, and a sealed second annular cavity 16 is formed between the lower joint 15 and the upper joint 306. The second annular cavity 16 accommodates a flow rate detection module 17 and a second communication module 18 in communication connection with the first communication module. An upper end of the flow rate detection module 17 stretches out from the second annular cavity and into the first annular cavity 305, and the second communication module 18 is in communication connection with the control circuit and the flow rate detection module 17.

As shown in FIG. 3, the way in which the sealed second annular cavity 16 is formed between the lower joint 15 and the upper joint 306 is that the side wall of the upper joint 306 is bent radially inward under the inner tube 307 to form a first sealed section 306*a*, which is then bent downward to form a second sealed section 306*b*, and the lower joint 15, the first sealed section 306*a* and the second sealed section 306*b* jointly define the sealed second annular cavity 16.

In this embodiment, the flow rate detection module 17 may be a flow rate sensor that can transmit the detected water distribution flow rate to the first communication module via the second communication module 18, and then the detected water distribution flow rate is transmitted to the controller 6 via the cable 14 for real-time displaying on the display.

It can be seen that the downhole data communication device 13 having the first communication module can realize bidirectional communication. That is, on the one hand, it can provide the control instruction issued by the controller 6 to the motor via the second communication module 18 and the control circuit, so as to realize the control of positive and negative rotations and the number of rotations of the motor; on the other hand, it can receive the water distribution flow rate detected by the flow rate detection module 17 via the second communication module 18 and transmit it to the controller 6 via the cable 14 for real-time displaying on the display.

Further, a lower end of the inner pipe 307 is spaced apart from the first sealed section 306*a* to form the water inlet 303*a*, an upper end of the flow rate detection module 17 passes through the first sealed section 306*a*. To be specific, the first sealed section 306*a* is provided with a through-hole through which the flow rate detection module 17 is provided, such that the upper end of the flow rate detection module 17 faces the water inlet 303*a*.

In the present invention, the controller 6, the first communication module and the second communication module 18 may be implemented in any suitable manner. To be specific, for example, the controller 6, the first communication module and the second communication module 18 may be, for example, a microprocessor or processor, a computer-readable medium that stores computer-readable program codes (e.g., software or firmware) executable by the microprocessor or processor, a logic gate, a switch, an application specific integrated circuit (ASIC), a programmable logic controller (PLC) and or an embedded microcontroller unit (MCU). Examples of the above modules include, but are not limited to, the following microcontroller units: ARC 625D, Atmel AT91SAM, Microchip PIC18F26K20 and Silicon Labs C8051F320. Persons skilled in the art shall also be aware that, in addition to implementing the functions of the controller 6, the first communication module and the second communication module 18 by using pure computer readable program codes, it is entirely feasible, by performing logic programming of the method steps, to enable the control unit to realize the same functions in the form of a logic gate, a switch, an application specific integrated circuit, a programmable logic controller 6 and an embedded microcontroller unit.

The working flow of the stratified waterflooding apparatus according to the embodiments of the present invention is introduced below.

The water distribution unit 3 is connected to the lower end of the oil pipe 1 and is lowered into the casing pipe 2. A logging truck is used, and the downhole data communication device 13 is carried by the cable 14 to be lowered into the oil pipe 1. When the downhole data communication device 13 is lowered to a level of the upper end of the water distribution unit 3, it is continued to be lowered slowly. After the position of the upper water distributor 301 is determined and the downhole data communication device 13 is successfully docked with the intelligent water distributor 301, the successful docking of it with the lower water distributor 301 is also completed. Then, real-time monitoring and control of the two water distributors 301 can be realized.

Electricity is supplied through the cable 14 to wake up the upper and lower water distributors 301 in turn and establish communication therewith. Real-time transmission of instructions for performing measurement and adjustment and for changing an injection allocation amount is enabled. The downhole water distribution flow rate and stored historical data can be transmitted to the controller 6. Bidirectional communication is adopted between the downhole data communication device 13 and the water distributors 301. When the downhole data communication device 13 is lowered into the well, it can perform wireless communication with both water distributors 301 at the same time without moving, thus finishes testing and adjustment of the flow rate of the two layers down in the well and recording of the historical data, and thereby realizes monitoring of information such as the well head stratified flow rate and the aperture of the water distributors 301 and real-time monitoring and control of downhole instruments.

The stratified waterflooding apparatus according to the embodiments of the present invention can obtain the following technical effects.

1. Bundling of the cable 14 is not required during the well repairing work, thus the construction is simple, the efficiency is high, and the cost is low; and no ground operating vehicle and equipment is needed, thus the labor intensity is greatly reduced.

2. Two-layer waterflooding is adopted for over 87% of the stratified waterflooding wells of Changqing oil field. This process realizes integration of the water distributors 301 of the two-layer waterflooding wells, and is suitable for most of the stratified waterflooding wells of Changqing oil field. The ground control and monitoring of the whole process relieve the working staff from manual casting-and-fishing and from measuring and adjusting works, which improves working efficiency and saves measuring and adjusting costs. Besides, the monitoring of information such as the wellhead stratified flow rate and the aperture of the water distributors 301 and the real-time monitoring and control of downhole instruments are also realized.

3. The device leads the cable 14 into the oil pipe 1, and realizes operations under pressure, and thus solves the technical problem that the external cable 14 is easy to wear, the construction difficulty is great and operations under pressure cannot be carried out when a cable digital stratified waterflooding technique with a preset external cable 14 is employed.

4. The device realizes stratified measurement and adjustment of the waterflooding wells, management of the wells and dynamic monitoring of the wells without the help of other supporting equipment and personnel, and thus lays a foundation for big data processing and application, and provides exhaustive first-hand data and documents for geologists to dynamically adjust the oil reservoirs in the region and optimize the waterflooding policies.

5. No influence will be brought to the subsequent management measures taken on the waterflooding wells. If the well repairing work is demanded again, there is only a need to lift the downhole data communication device 13 out from the well by the logging truck and then lower it again into the well after the well repairing work has been done.

What needs to be explained is that, in the description of the present application, the terms such as "first" and "second" are used only for purpose of description and for distinguishing between similar objects, do not represent a sequential order between the two, and also cannot be understood as indicating or implying a relative importance. Besides, in the description of the present application, unless otherwise explained, the meaning of "plural" means two or more.

It should be understood that the above description is for graphic illustration rather than limitation. By reading the above description, many embodiments and applications other than the provided examples would be obvious for persons skilled in the art. Therefore, the scope of the teaching should be determined not with reference to the above description, but should instead be determined with reference to the appended claims, along with the full scope of equivalents possessed by the claims. The disclosures of all articles and references, including patent applications and publications, are incorporated herein by reference for purpose of being comprehensive. The omission in the foregoing claims of any aspect of the subject matter that is disclosed herein is not a disclaimer of such subject matter, nor should it be regarded that the inventor did not consider such subject matter to be part of the disclosed inventive subject matter.

The invention claimed is:

1. A stratified waterflooding apparatus, comprising:

a water distribution unit connected to an oil pipe and lowered into a casing pipe, the water distribution unit comprising: two water distributors and a packer connected between the two water distributors, the packer being settable on the casing pipe, and the water distributors having an inner side wall and an outer side wall, the inner and outer side walls forming a first annular cavity therebetween and being respectively provided with a water inlet and a water outlet which are communicated with the first annular cavity, the first annular cavity accommodates a driving mechanism and an adjustable blocking member driven by the driving mechanism, and the adjustable blocking member having a first operating position in which it blocks the water inlet or the water outlet such that the water inlet and the water outlet cannot communicate with each other via the first annular cavity and a second operating position in which it releases the blocking of the water inlet and the water outlet so that the water inlet and the water outlet can communicate with each other via the first annular cavity; and a controller in communication connection with the driving mechanism, wherein the packer and the two water distributors form a channel which is used for passage of a liquid therethrough and is communicated with the oil pipe, a downhole data communication device having a first communication module is provided within the channel, the downhole data communication device is in communication connection with the controller, and the first communication module is in communication connection with the driving mechanism;

wherein the driving mechanism includes a control circuit in communication connection with the first communication module and a motor connected with the control circuit;

wherein the water distributor includes an upper joint, a side wall of which forms the outer side wall and an inner tube connected with the upper joint, a side wall of which inner tube forms the inner side wall; and wherein a lower end of the upper joint is connected with a lower joint, a sealed second annular cavity is formed between the lower joint and the upper joint, the second annular cavity accommodates a flow rate detection module and a second communication module in communication connection with the first communication module, an upper end of the flow rate detection module stretches out from the second annular cavity and into the first annular cavity, and the second communication module is in communication connection with the control circuit and the flow rate detection module.

2. The stratified waterflooding apparatus according to claim 1, wherein, the downhole data communication device is connected with the controller via a cable, which is provided to pass through the oil pipe and the channel.

3. The stratified waterflooding apparatus according to claim 1, wherein, the adjustable blocking member is provided with a screw hole on an upper end thereof, an output shaft of the motor is connected with a screw rod, and the screw rod is screwed into the screw hole.

4. The stratified waterflooding apparatus according to claim 1, wherein, the downhole data communication device realizes bidirectional communication, namely:

the downhole data communication device can provide a control instruction issued by the controller to the motor via the second communication module and the control circuit, so as to realize control of positive and negative rotations of the motor and the number of rotations of the motor; and the downhole data communication device can receive a water distribution flow rate detected by the flow rate detection module via the second communication module and transmit the water distribution flow rate to the controller.

5. The stratified waterflooding apparatus according to claim 1, wherein, the side wall of the upper joint is bent radially inward under the inner tube to form a first sealed section, which is then bent downward to form a second sealed section, and the lower joint and the first and second sealed sections jointly define the sealed second annular cavity.

6. The stratified waterflooding apparatus according to claim 5, wherein, a lower end of the inner tube is spaced apart from the first sealed section to form the water inlet, and an upper end of the flow rate detection module passes through the first sealed section, such that the upper end of the flow rate detection module faces the water inlet.

7. The stratified waterflooding apparatus according to claim 1, wherein, the water outlet is located above the water inlet, the adjustable blocking member blocks the water outlet when it is in the first operating position, and the adjustable blocking member at least partially opens the water outlet when it is in the second operating position.

* * * * *